United States Patent [19]

Van Stokes et al.

[11] Patent Number: 4,674,938

[45] Date of Patent: Jun. 23, 1987

[54] VEHICLE PARKING SYSTEM

[75] Inventors: William Van Stokes, Poolville; William C. Gooch, Fort Worth, both of Tex.

[73] Assignee: Car Stackers International, Inc., Fort Worth, Tex.

[21] Appl. No.: 774,994

[22] Filed: Sep. 11, 1985

[51] Int. Cl.[4] ..... E04H 6/06

[52] U.S. Cl. ..... 414/228; 187/8.50; 187/8.59; 254/89 H

[58] Field of Search ..... 414/228, 229, 240, 242, 414/246, 247, 249, 251, 254, 227; 254/89 H; 187/8.49, 8.50, 8.59, 20

[56] References Cited

U.S. PATENT DOCUMENTS

| | | | |
|---|---|---|---|
| 2,242,892 | 5/1941 | Light | 414/240 |
| 2,280,567 | 4/1942 | Austin | 414/228 X |
| 2,455,507 | 12/1948 | Light | 414/249 X |
| 2,640,562 | 6/1953 | Villars | 187/8.59 |
| 3,750,899 | 8/1973 | Greer | 414/240 |
| 3,941,257 | 3/1976 | Matsuura | 414/229 X |
| 3,985,207 | 10/1976 | Petit | 187/8.59 X |
| 4,015,733 | 4/1977 | Woehr, Sr. et al. | 414/249 |
| 4,455,115 | 6/1984 | Alger et al. | 187/20 X |
| 4,551,054 | 11/1985 | Klaus | 414/249 |

FOREIGN PATENT DOCUMENTS

| | | | |
|---|---|---|---|
| 1417016 | 9/1965 | France | 414/228 |

*Primary Examiner*—Joseph E. Valenza
*Assistant Examiner*—David A. Bucci
*Attorney, Agent, or Firm*—Arthur F. Zobal

[57] ABSTRACT

A frame supported by a base has at least an upper platform and a lower platform adapted to be nested together and supported at lower positions by the base. The upper and lower platforms are adapted to be moved upward for supporting vehicles above the ground. Lifting mechanism is provided for lifting the upper platform with a vehicle thereon to a first upper level sufficient to allow a vehicle to be located on the lower platform. Connecting straps extend between the two platforms such that when the upper platform is moved upward beyond the first upper level, the lower platform is pulled upward by the connecting straps. The lifting mechanism is adapted to move the upper platform with a vehicle thereon upward to a second upper level sufficient to pull the lower platform with a vehicle thereon to a level sufficient to allow a vehicle to be driven thereunder.

20 Claims, 11 Drawing Figures

Fig. 4
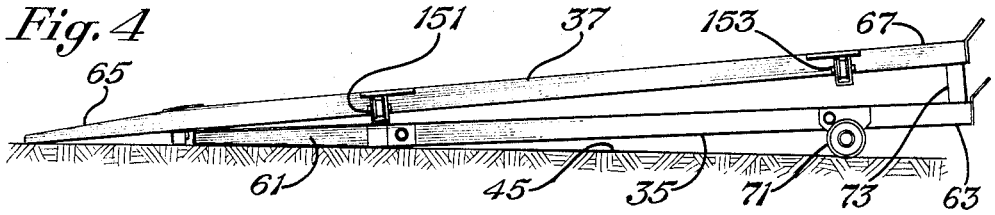
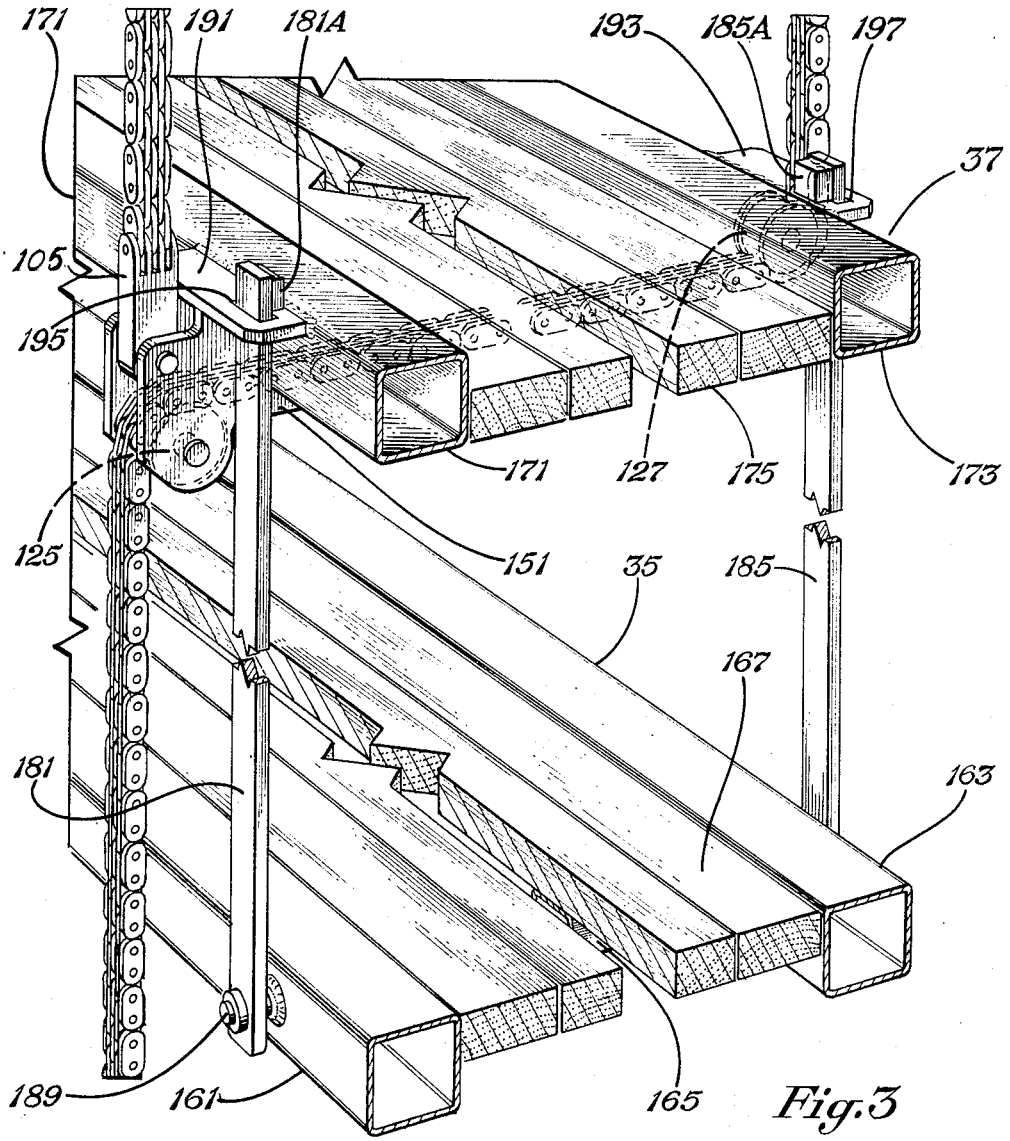
Fig. 3

VEHICLE PARKING SYSTEM

BACKGROUND OF THE INVENTION

1. Field of the Invention

A vertical lift system for parking motor vehicles.

2. Description of the Prior Art

Single-level and multi-level parking systems for automobiles, trucks, etc. have been used for many years. Single-level parking is not cost effective and multi-story parking buildings are too expensive for the average installation. Vertical lift systems have also been employed but the known systems are too expensive and mechanically complex. U.S. Pat. Nos. 2,579,688, 3,387,722, 3,706,356, 3,750,899, and 4,209,276 disclose different types of vertical lift systems.

SUMMARY OF THE INVENTION

It is an object of the present invention to provide a simple and cost effective vertical lift system for parking motor vehicles at different levels.

The system comprises a frame comprising structural means extending upward from a base, and a plurality of platforms adapted to be nested together and supported at lower positions by said base. The plurality of platforms comprise at least a first platform and a second platform located above said first platform. Said first and second platforms are adapted to be moved upward between said structural means. Said second platform has a first end and a second end with dimensions sufficient to allow a motor vehicle to be driven thereon from its first end when said second platform is supported at its lower position. Lifting means is provided for moving said second platform with a motor vehicle thereon upward to a first upper level sufficient to allow a motor vehicle to be located thereunder on said first platform. Said first platform has a first end and a second end with dimensions sufficient to allow a motor vehicle to be driven thereon from its first end when said first platform is supported at its lower position. Connecting means extends between said first and second platforms such that when said second platform is moved upward beyond said first upper level, said first platform is pulled upward by said connecting means. Said lifting means is adapted to move said second platform with a motor vehicle thereon upward to a second upper level sufficient to pull said first platform with a motor vehicle thereon to a level sufficient to allow a motor vehicle to be driven thereunder.

In the preferred embodiment, the lifting means comprises a single power cylinder and two sets of lift chains for lifting the front and rear ends of said second platform. A second set of chains is provided for maintaining the sides of said second platform level as it is moved upward. The connecting means comprises four straps connected to said first platform with said second platform being slidably coupled to said straps whereby said second platform may move upward to said first upper level relative to said straps at which point it engages means on said straps and pulls said straps and said first platform upward as it moves upward to said second upper level. The two platforms thus in effect are free floating which eliminates wear and alignment problems. The use of a single power cylinder has advantages since it avoids synchronization problems. The power cylinder and the two lift chains will be mounted on the downhill side of any grade whereby the platforms will conform to the ground when in their lower positions.

With this arrangement, the platforms can be installed from either end of the frame depending upon the direction of the grade.

DESCRIPTION OF THE DRAWINGS

FIG. 3 is a partial enlarged view of the two platforms of one of the lift systems of FIGS. 1 and 2 illustrating in more detail the lift and leveling chains at one end of the system.

FIG. 4 is a side view of two platforms of the system in a nested or stacked lower position.

DESCRIPTION OF THE PREFERRED EMBODIMENTS

Figure 1:
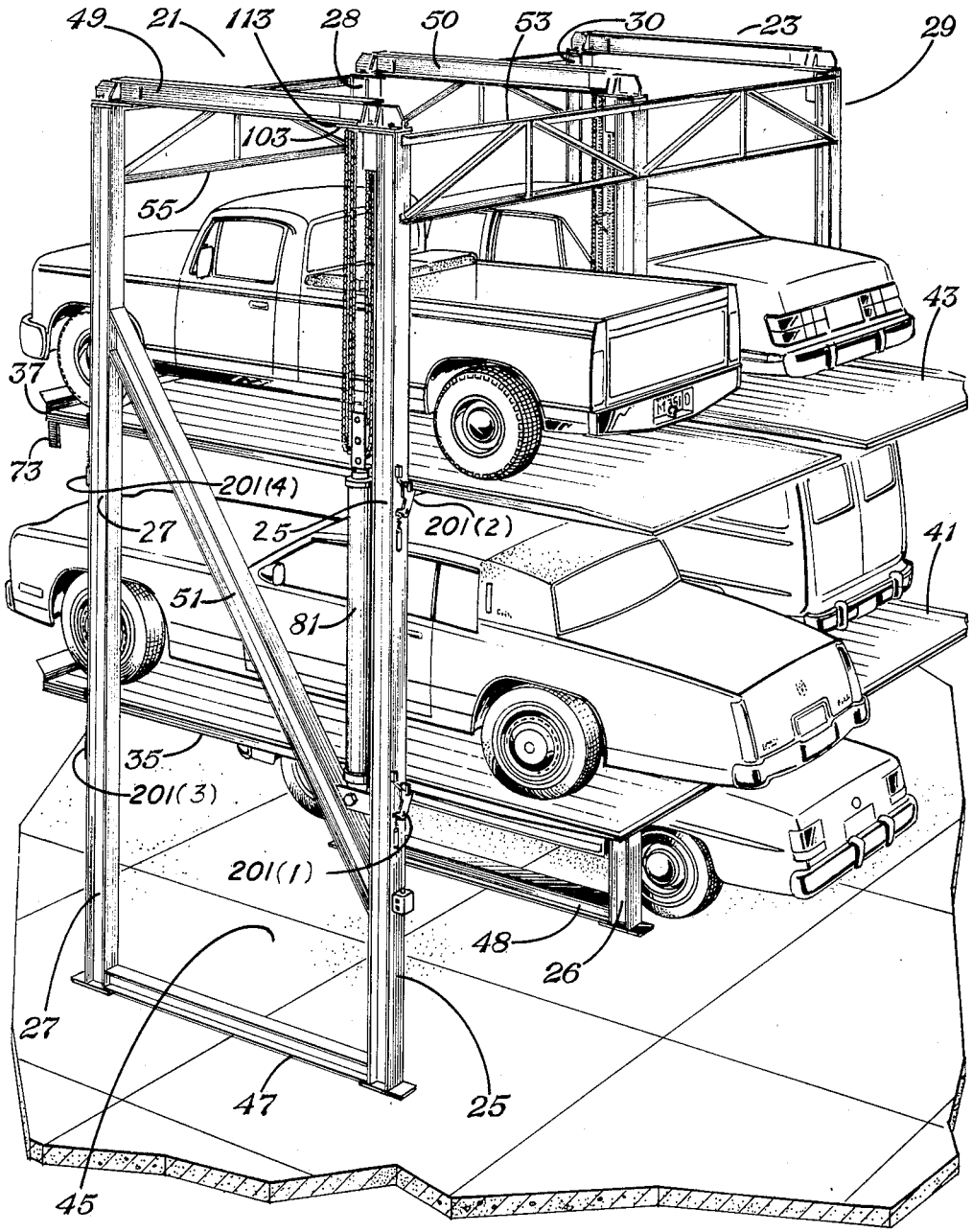
FIG. 1 is a perspective view of a parking system employing two side by side lift systems of the invention.
Figure 2:
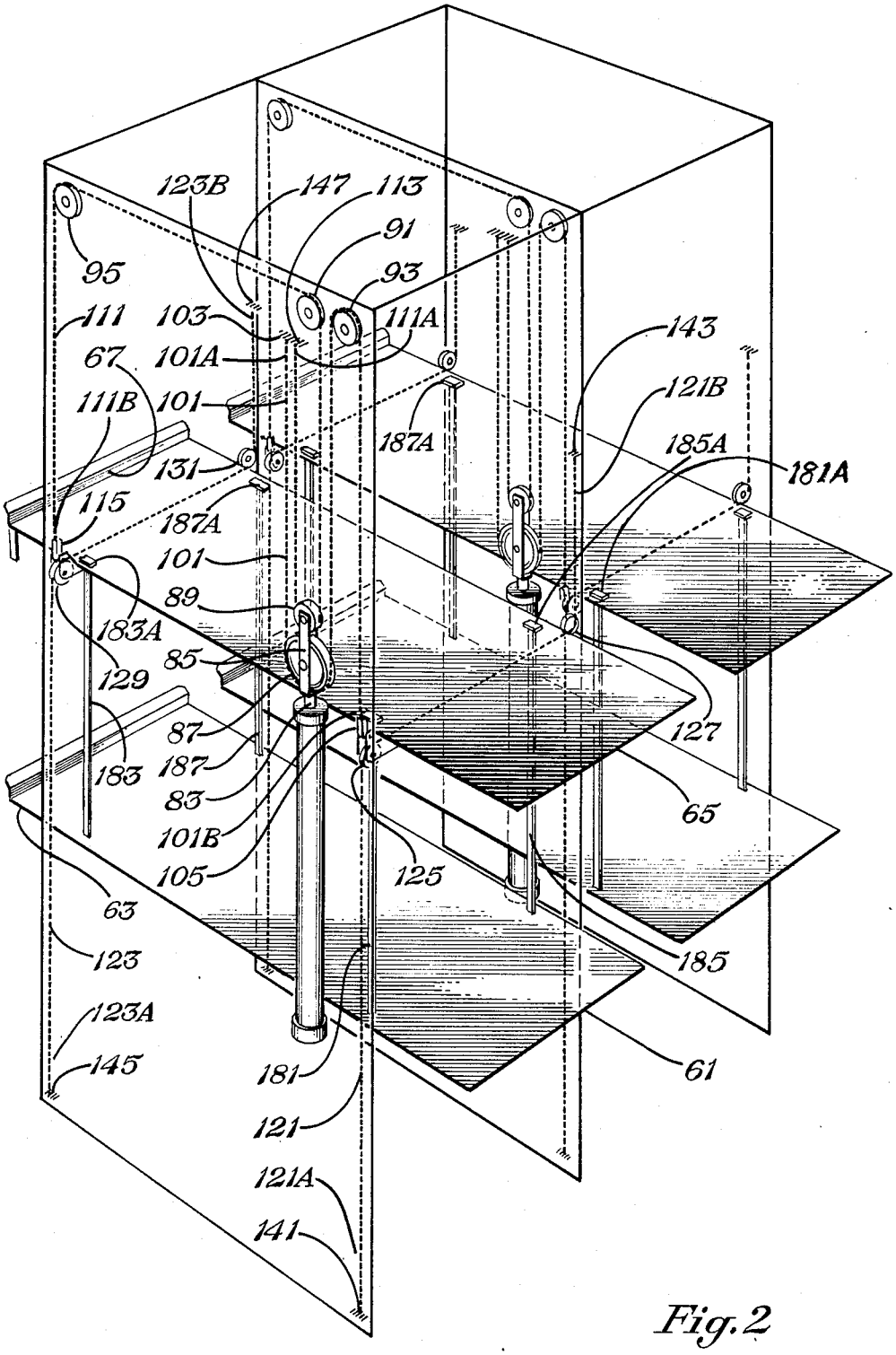
FIG. 2 is a schematic of FIG. 1 illustrating details of the lift and leveling systems of the platforms.

Referring now to FIGS. 1 and 2, there are shown at 21 and 23 two bays or two side-by side lift systems. The lift system 21 is formed by a frame comprising vertical frame members 25–28 and two vertically movable platforms or pans 35 and 37. The lift system 23 is formed by a frame comprising vertical frame members 26, 28, 29 and 30 and two vertically movable platforms 41 and 43. Both of the lift systems 21 and 23 share the frame members 26 and 28 and their associated cross beams. Only the lift system 21 will be described since the lift systems 21 and 23 are the same although their entrances may be reversed depending on the grade direction as will be described subsequently.

The lower ends of the frame members 25–28 are secured to a base 45 which preferably is of concrete or suitable hard material. Lower and upper cross members 47, 48 and 49, 50 are connected between the lower and upper ends of frame members 25, 27, and 26, 28 respectively. An angled cross member 51 is connected between frame members 25 and 27 as shown. A similar angled cross member (not shown) is connected between frame members 26 and 28. In addition, upper cross members 53 and 55 are connected between the upper ends of frame members 25, 26 and 27, 28 respectively.

For purposes of this discussion, frame members 25 and 26 define the front end of the frame and frame members 27 and 28 define the rear end of the frame. The two platforms 35 and 37 are located between frame members 25, 27 and 26, 28. Platform 35 has front and rear ends 61 and 63 and platform 37 has front and rear ends 65 and 67. Each of the platforms 35 and 37 has a width and length sufficient to allow a conventional automobile or small truck to be driven thereupon from its front end. Each of the platforms 35 and 37 is constructed to support and lift a vehicle to different levels. Platform 37 preferably is longer than platform 35.

The platforms 35 and 37 are adapted to be located in lower positions as shown in FIG. 4 wherein platform 35 is supported by the base 45 and platform 37 is nested or supported by platform 35 and the base 45. Two wheels 71 are connected to the opposite sides of the platform 35 near its rear end to cause the platform 35 to be tilted when it is supported by the base 45. Two legs 73 are connected to opposite sides of the platform 37 at its rear end for engaging the top of the rear end of the platform 35 in the lower nested position whereby the rear end of the platform 37 is supported by the platform 35 and the front end of the platform 37 is supported by the base 45 when the platforms are in their lower positions as shown in FIG. 4. In this position, the platform 37 is tilted relative to platform 35. In the lower nested position FIG. 4, a vehicle can be driven upon the platform 37 from its front end.

Figure 11:
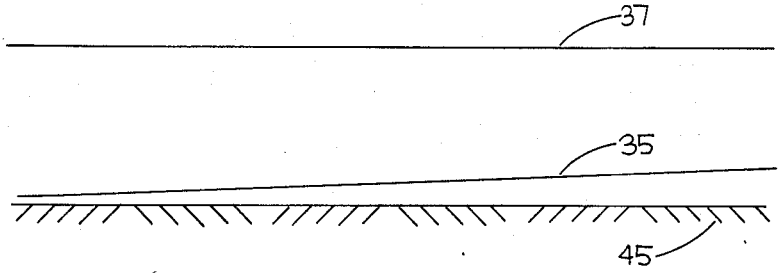
FIG. 11 schematically illustrates an intermediate position of the upper platform of the lift system.

A lift system is provided for leveling the platform 37 and then lifting the platform 37 and the vehicle to a first upper level as shown in FIG. 11. In this position, another vehicle can be driven upon the lower platform 35 from its front end. The lift system then lifts both platforms 35 and 37 and their vehicles to levels as shown in FIG. 1 such that a third vehicle can be driven under the platform 35 and parked on the base 45. Thus three vehicles can be parked at three different levels by the vertical lift system.

When it desired to remove the vehicles, the vehicle parked on base 45 is backed out from under the platform 35. Platforms 35 and 37 then are lowered until platform 35 is supported by base 45. The vehicle on platform 35 is backed off the platform. Next the platform 37 is lowered until it is nested and supported by the platform 35 and by the base 45 at which time the vehicle it supports can be backed off of the platform 37.

The system for lifting and lowering the platforms 35 and 37 now will be described. It comprises a single hydraulic power cylinder 81 connected to vertical frame member 25 and to angled cross member 51. The cylinder 81 carriers a piston 83 adapted to move upward out of the cylinder 81 at its upper end and downward into the cylinder. Support members 85 connected to the upper end of the piston 83 carry a large pulley 87 and a smaller pulley 89 which is located above pulley 87. Two pulleys 91 and 93 are supported by the cross beam 49 above the cylinder 81 and a third pulley 95 is supported at the other end of the cross beam 49. A first chain 101 has one end 101A connected to the cross beam 49 at 103. The chain 101 extends downward around pulley 87, upward around pulley 93, and then downward where its other end 101B is connected to platform 37 at 105. A second chain 111 has one end 111A connected to cross beam 49 at 113. The chain 111 extends downward around pulley 89, and upward around pulley 91, across to pulley 95 and then around the pulley 95 and downward where its other end 111B is connected to platform 37 at 115.

Front and rear leveling chains 121 and 123 also are provided for the platform 37. These chains extend around pulleys 125, 127, and 129, 131 carried by the platform 37 at its front and rear ends. As shown, pulleys 125 and 127 are supported by the platform 37 on opposite sides near its front end and pulleys 129 and 131 are supported by the platform 37 on opposite sides near its rear end.

The chain 121 has one end 121A connected to the frame member 25 near its lower end at 141. The chain 121 extends upward around pulley 125 across to pulley 127 around pulley 127 and then upward where its other end 121B is connected at 143 to the frame member 26. The chain 123 has one end 123A connected to the lower end of the frame member 27 at 145. The chain 123 extends upward and around the pulley 129, across to pulley 131, around the pulley 131 and then upward where its other end 123B is connected at 147 to frame member 28. The pulleys 125 and 127 are supported at opposite ends of a tubular member 151 which extends across the width of the platform 37 near its front end. The chain 121 extends through the tubular member 151 from pulley 125 to pulley 127. The pulleys 129 and 131 are coupled to opposite ends of a tubular member 153 which extends across the width of the platform 37 near its rear end. The chain 123 extends through the tubular member 153 from pulley 129 to pulley 131. This is shown in FIGS. 2, 3, 4 and 9.

As shown in FIG. 3, platform 35 is constructed of two elongated square tubular beams 161 and 163 located on each side thereof which extend along the length of the platform. Cross beams 165 are connected to the beams 161 and 163 at their front and rear ends and support wooden planks 167 which are connected to the beams 165. Platform 37 is constructed of two elongated square tubular beams 171 and 173 located on each side thereof which extend along the length of the platform. Square tubular members 151 and 153 are connected to beams 171 and 173 and support wooden planks 175 which are connected to the members 151 and 153.

Two metal straps 181 and 183 have their lower ends pivotally coupled to the outer side of beam 161 at its front and rear ends and two metal straps 185 and 187 have their lower ends pivotally coupled to the outer side of beam 163 at its front and rear ends. Pivotal connection is by way of pins illustrated at 189 in FIG. 3. Beams 171 and 173 have plates 191 and 193 extending outward from their outer sides at their front and rear ends with holes 195 and 197 formed there through for slidably receiving straps 181, 183 and 185, 187. The plates 191 and 193 at the rear end of platform 37 are not shown although they will be the same as the plates 191 and 193 shown at the front end of platform 37. Straps 181, 183 and 185, 187 have lugs 181A, 183A and 185A, 187A welded to their top ends which engage the plates 191 and 192 when the platform 37 is lifted upward above its intermediate level causing the straps 181, 183, 185, 187 to lift the platform 35 to its upper level as shown in FIG. 1 as the platform 37 is lifted to its upper level.

The manner in which the lift mechanism operates now will be described. Assume that the platforms 35 and 37 are in their lower positions as shown in FIG. 4. In this position, the piston 83 will be at its maximum outward and upward extended position. Since the platform 37 has its rear end tilted up, there will be some slack in the chain 111. When the hydraulic cylinder 81 is actuated to move its piston 83 inward and hence downward, the chain 101 first will lift the front end 65 of the platform 37 until the platform is level at which time both the chains 101 and 111 will lift the front and rear ends of the platform 37 upward maintaining the front and rear ends level. At the same time, the chains 121 and 123 will maintain the sides of the platform 37 level. As the platform 37 moves upward to its first upper level, the plates 191 and 193 will slide along the straps 181, 183, 185, 187. When the platform 37 reaches its intermediate or first upper position, the cylinder 81 will be deactuated to stop movement of its piston and hence of the platform 37. When it is desired to lift both of the platforms 37 and 35, the cylinder 81 will be actuated again to cause its piston 83 to be moved downward further thereby causing the chains 101 and 111 to lift the platform 37 to its maximum upper position, causing the straps 181, 183, 185, 187 to lift the lower platform 35 to its upper position when the platform 37 reaches its maximum upper position. At this point, the cylinder 81 is deactuated to stop movement of the platform 37 and hence movement of the platform 35.

When it is desired to lower the platforms, the cylinder 81 is actuated in a reverse direction thereby causing its piston 83 to move upward. This allows the chains 101 and 111 to lower the platform 37 and hence the platform 35 until the intermediate position is reached for the platform 37 with the platform 35 resting on the base 45. The cylinder 81 is deactuated to stop further movement of the platform 37. In order to lower the platform 37 to its lower position as shown in FIG. 4, the cylinder 81 is again actuated to move its piston upward further to allow the platform 37 to be lowered by the chains 101 and 111 until it engages the platform 35 and base 45. During this movement of the platform 37 downward from its intermediate position, the plates 191 and 192 will slide relative to the straps 181, 183, 185, 187. When the platforms 35 and 37 are in the lower positions as shown in FIG. 4, the straps 181, 183, 185, 187 will extend upward above the platform 37 on its two opposite sides. The aperatures or slots 195 and 197 will hold the straps 181, 183, 185, 187 in a generally vertical position whereby they will not interfere with movement of a vehicle onto or off of the platform 37.

Referring to FIG. 1, there are provided mid and upper safety latch mechanisms 201 (1) and 201 (2) on the main side frame member or leg 25 and mid and upper safety latch mechanisms 201(3) and 201 (4) on the off side frame member or leg 27. The latch mechanisms 201(1) and 201(2) are identical and the latch mechanisms 201 (3) and 201 (4) are identical. Latch mechanisms 201 (1) and 201 (3) operate together and latch mechanisms 201 (2) and 201 (4) operate together to prevent the platforms 35 and 37 from lowering in the event that failure of the electrical or hydraulic system occurs.

Figure 5:
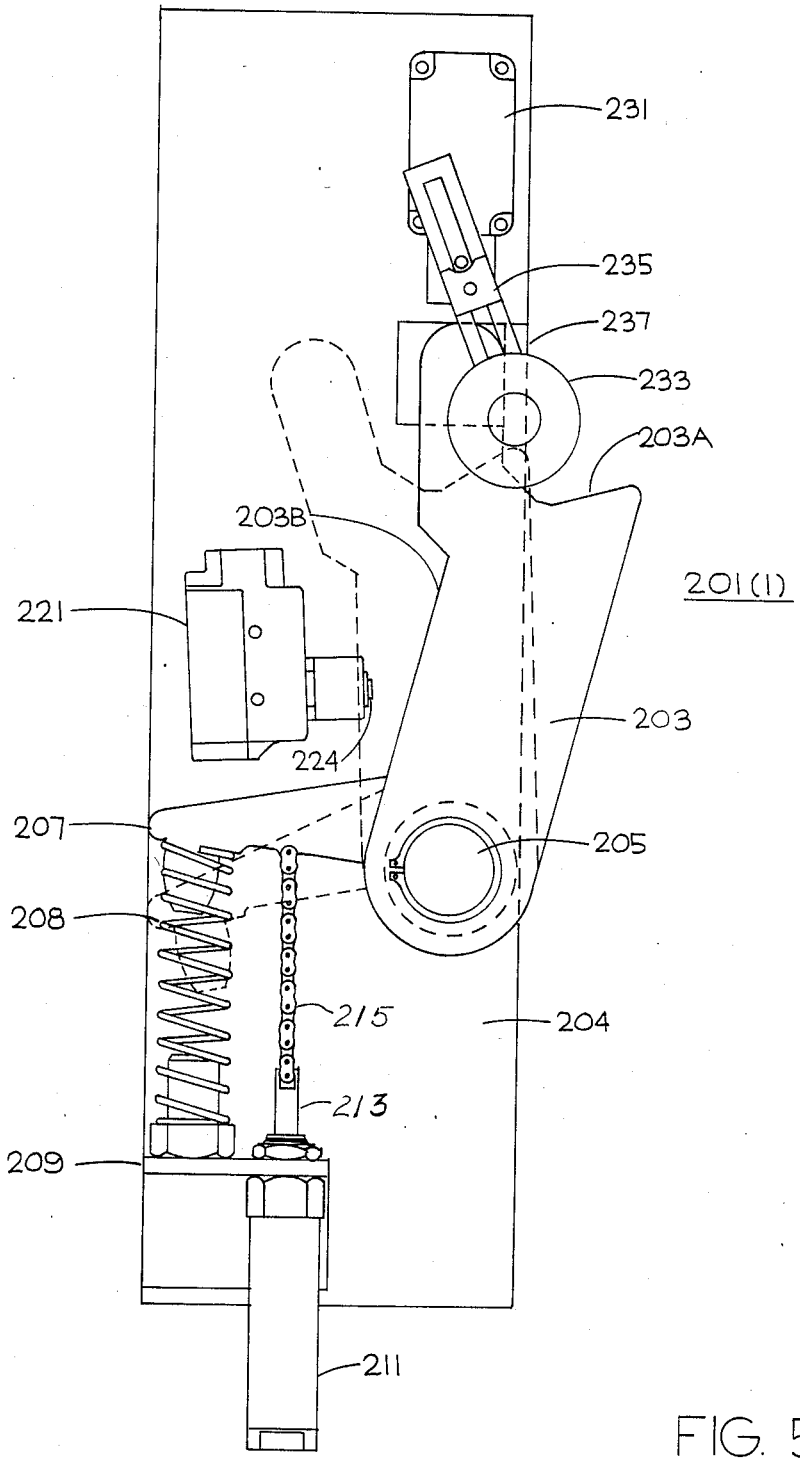
FIG. 5 illustrates a safety latch mechanism used at one end of the frame of the lift system.

Referring to FIG. 5, since latch mechanisms 201 (1) and 201 (2) are identical only latch mechanism 201 (1) will be described. It comprises a latch member 203 coupled to a plate 204 by a pin 205. Plate 204 is connected to the leg 25 of the frame. Connected to the latch member 203 is an arm 207. A compression spring 208 engages the arm 207 and a tab 209 which is connected to the plate 204. The spring 208 urges the latch member 203 in a clock wise direction as shown in FIG. 5 whereby the portion 203A normally is located inward of the leg 25 and in the path of the platforms. As the platforms move upward, they can move the latch member 203 and hence pass upward beyond the latch. When the platforms move downward, however, they will engage the portion 203A and be prevented from moving downward unless the latch member 203 is moved counter clock-wise (as shown in FIG. 5) and out of the way of the platforms, by a cylinder 211 and a piston 213 which is coupled to the arm 207 by way of a chain 215. A safety switch 221 is provided which is actuated when the latch member 203 is moved counter clockwise by the hydraulic cylinder 211 to a position where its back side 203B engages the button 224. In addition, a position sensor switch 231 is provided which is actuated by a roller 233 and arm 235 when a platform moves past the roller 233 and causes the roller and hence the arm 235 to pivot clockwise as shown in FIG. 5. Roller 233 is in a different plane than latch member 203. Tab 237 limits inward movement of latch member 203.

Figure 6:
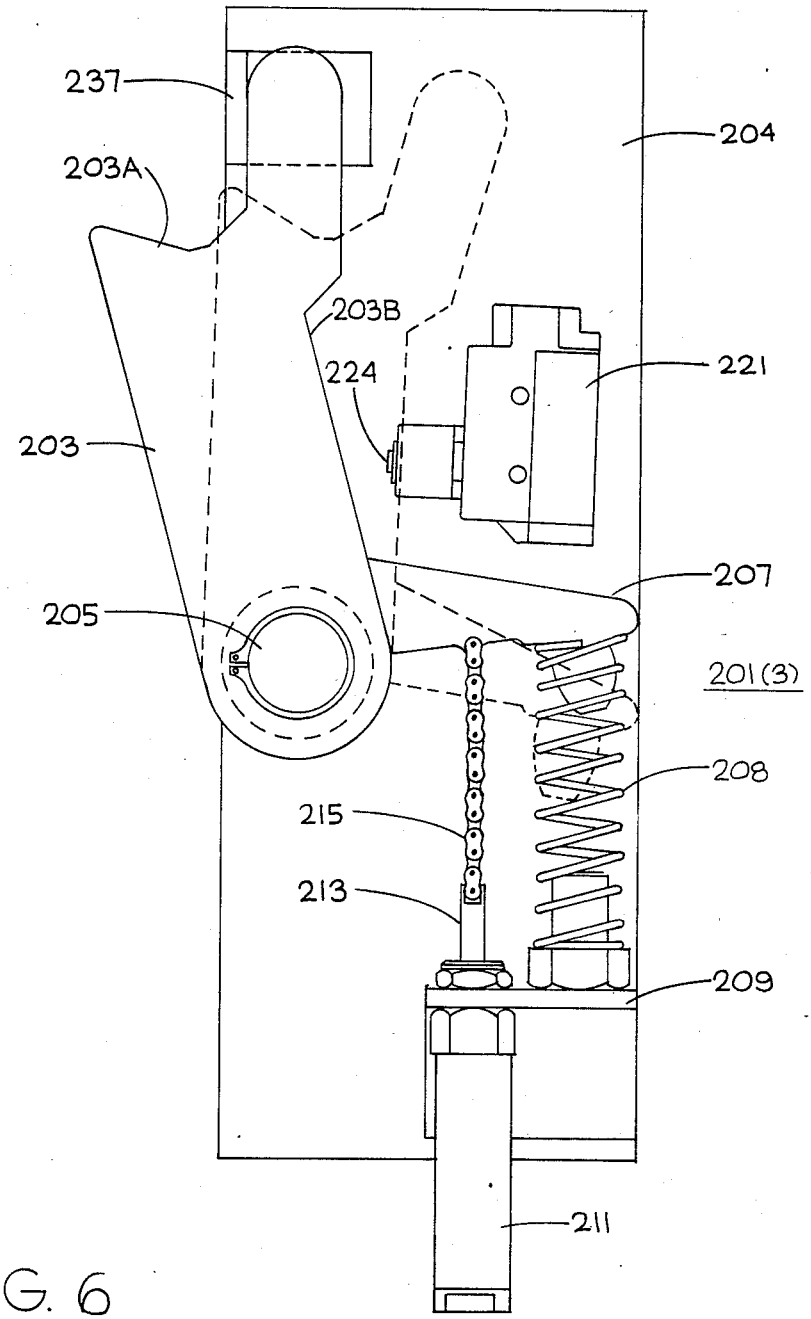
FIG. 6 illustrates a safety latch mechanism used at the other end of the frame of the lift system.

Latch mechanisms 201 (3) and 201 (4) are the same as latch mechanisms 201 (1) and 201 (2) except that they do not have the position sensor switch 231, arm 235, and roller 233. Latch mechanism 201 (3) is shown in FIG. 6.

For purposes of this discussion, switches 221 of latch mechanisms 201 (1), 201 (2), 201 (3) and 201 (4) will be identified by reference numbers 221 (1), 221 (2), 221 (3) and 221 (4) respectively. They are normally open switches. Switches 231 of units 201 (1) and 201 (2) will be identified by reference numerals 231 (1) and 231 (2) respectively. Switch 231 (1) comprises two switches 231 (1)A and 231 (1)B which are normally closed and open respectively. Switch 231 (2) comprises two switches 231 (2)A and 231 (2)B which are normally closed and open respectively. Cylinders 211 of units 201 (1), 201 (2), 201 (3) and 201 (4) will be identified by reference numerals 211 (1), 211 (2), 211 (3) and 211 (4) respectively. Safety latches 203 of units 201 (1), 201 (2), 201 (3) and 201 (4) wil be identified by reference numerals 203 (1), 203 (2), 203 (3), and 203 (4) respectively.

Figure 7:
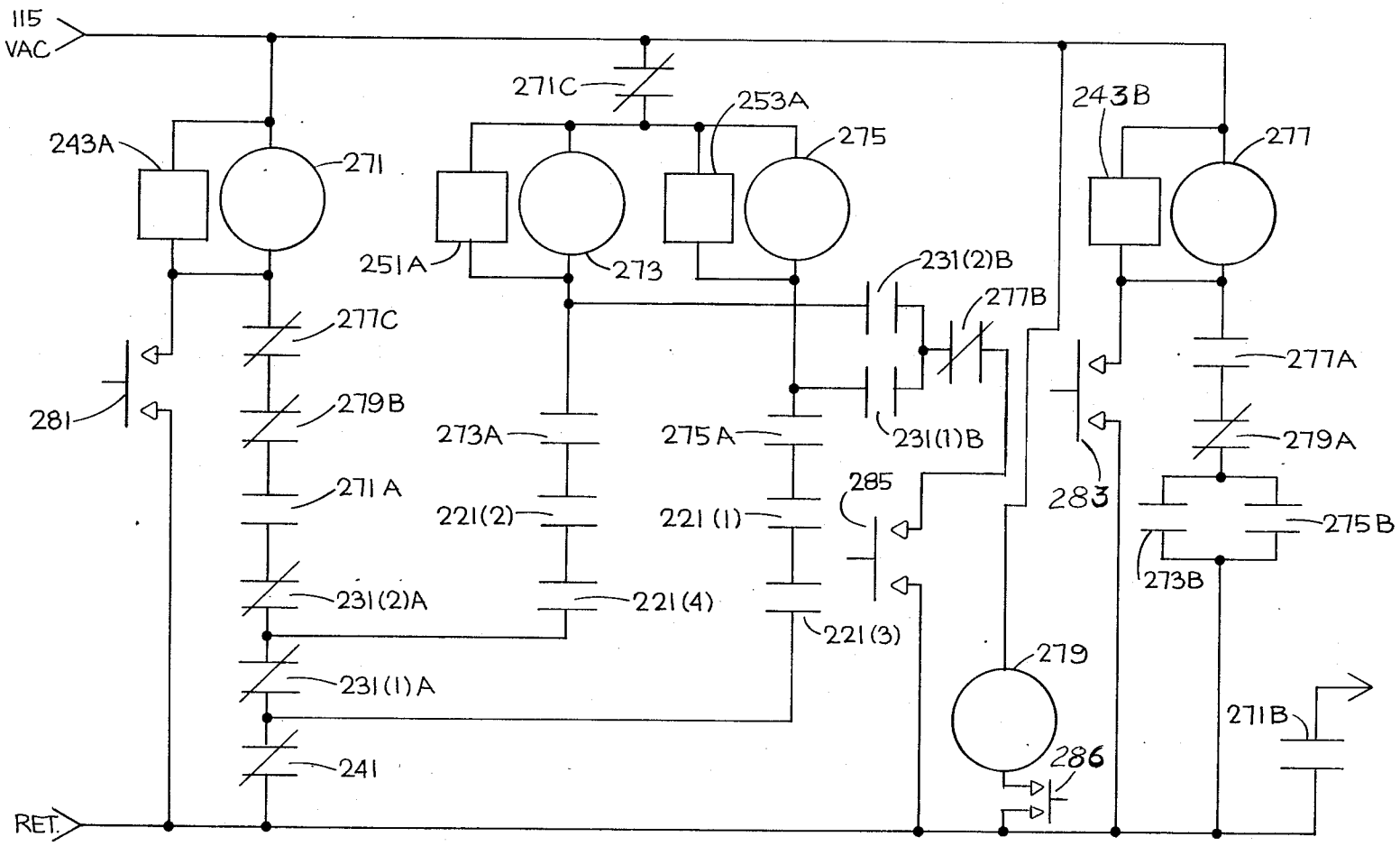
FIG. 7 is a schematic of the electrical system of the lift system.
Figure 8:
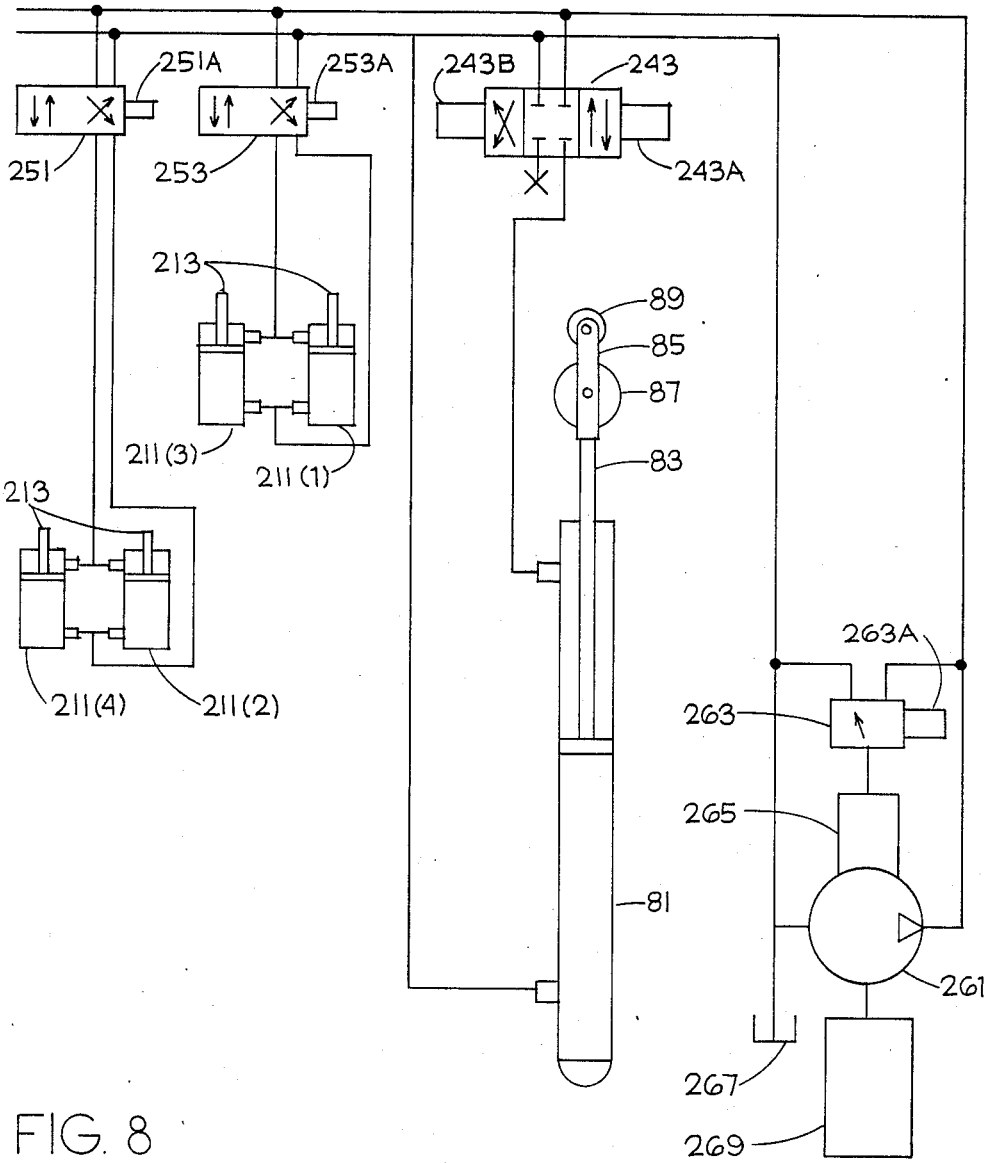
FIG. 8 is a schematic of the hydraulic system of the lift system.

Referring now to FIGS. 7 and 8, there will be described the electrical and hydraulic system and the manner of operation. There are three platform position sensors. Switch 241 is a switch located at the top of the frame and is normally closed. When the piston 83 of the power cylinder 81 is at its maximum outward (upward) position and both platforms are in the lower nested position on the base 45, the switch 241 will be open. The mide sensor switches 231 (1)A and 231 (1)B are actuated (opened and closed respectively) when the platform 37 is raised to its first upper level. The upper sensor switches 231 (2)A and 231 (2)B are actuated (opened and closed respectively) when the platform 37 is raised to its maximum upper level. Upper latch switches 221 (2) and 221 (4) are connected together in series and both are closed then the upper latches are fully retracted. Mid latch switches 221 (1) and 221 (3) are connected together in series and both are closed when the lower latches are fully retracted.

There is a control circuit for the main cylinder 81. It comprises a three position, four way valve 243 which is spring centered, fully closed center, 12 volt DC solenoid operated. Its two solenoids are identified at 243A and 243B.

The latch cylinders retraction circuit comprises a pair of two position four way valves 251 and 253, spring offset, 12 volt DC solenoid actuation for each set of latches. Pressure normally is sent to retract the cylinders 211 (1), 211 (3), and 211 (2) 211 (4). The solenoids of valves 251 and 253 are identified at 251A and 253A.

There is a pump compensator circuit for the hydraulic pump 261. The circuit comprises a two position spring offset, three way valve 263, 12 volt DC solenoid operated, that normally dumps the pressure compensator 265 to the hydraulic fluid tank 267, but when its solenoid 263A is energized, pressure is directed to the bottom of the solenoid spool, thereby bringing the pressure up to that required to lift the vehicle or to the preset maximum pressure. Member 269 is an electric motor for operating the pump 261.

There are five relays 271, 273, 275, 277 and 279. Up relay 271 closes normally open switches 271A and 271B and opens normally closed switch 271C when energized. The solenoid 263A is activated when switch 271B is closed. Up safety relay 273 closes normally open switches 273A and 273B when energized. Mid safety relay 275 closes normally open switches 275A and 275B when energized. Down relay 277 closes normally open switch 277A and opens normally closed switches 277B and 277C when energized. Emergency stop relay 279 opens normally closed switches 279A and 279B when energized.

The control circuits comprise an up controller, a latch controller, a down controller and an emergency stop controller. When the up button 281 is pushed, the pump compensator circuit is energized, the up solenoid 243A of the main cylinder control valve is energized, the up relay latching circuit is locked in, and the pressure from the pump 261 is directed to the rod side of the cylinder 81. This causes the platform 37 to raise until the appropriate platform position switch is actuated, indicating that the platform 37 has reached the next upper level. At this point, the main control valve 243 centers, stopping the platforms. The pump compensator control valve dumps the compensator spool line dropping the pump pressure to approximately 150 psi.

The latch controller circuit checks the platform sensors to determine which set of latches should be retracted. The latching relay is locked in energizing the control valve for the latches, immediately under the upper platform 37, sending pressure to the latch retraction cylinders. The down relay then is ready to latch.

When the down button 283 is pushed, the electronics check to make sure that the safety latches are both fully retracted. The down solenoid 243B of the main cylinder control valve then is energized. The latching relay is locked and the platforms descend until the platform position sensors indicate that the next lower position has been reached. The down latching relay opens; the main cylinder control valve centers; the latch ltching relay is opened; the latch control valve releases and the latches spring into engaged positions.

When the emergency stop safety switch 286 is pushed, the emergency stop controller deactivates all electrical circuits in the entire installation. No platform will move until the control buttons are re-pushed to restart the sequences.

Switches 281, 283 and 285 are spring biased normally open, push button switches.

There now will be described in more detail the operation of the electrical and hydraulic system for raising and lowering the platforms 37 and 35. Assume that both platforms 37 and 35 are in the lower nested positions as shown in FIG. 4. In this position switch 241 will be open. A vehicle is driven onto the platform 37. In order to raise the platform 37, switch 281 is pushed to close the switch. This causes relay 271 and the up solenoid 243A to be energized. Switches 271A and 271B close and switch 271C opens. When switch 271B closes, the hydraulic pump actuates and the platform 37 starts to move upward. This allows switch 241 to close. When switch 241 closes, a circuit is completed to relay 271 and solenoid 243A by way of closed switches 241, 231 (1)A, 231 (2)A, 271A, 279B, and 277C. The relay 271 and solenoid 243A thus are latched in when the operator takes his finger off of switch 281. The platform 37 continues to move up until it reaches and opens the mid limit switch 231 (1)A. When switch 231 (1)A opens, switch 231 (1) B closes. Relay 271 and solenoid 243A then are de-energized. Switch 271A opens, switch 271C closes and switch 271B opens, deactivating the hydraulic pump causing platform 37 to stop at its first upper level as illustrated in FIG. 11.

A vehicle then can be driven onto platform 35. Switch 281 then is pushed causing relay 271 and solenoid 243A to be energized and then latched in as the platform 37 again is raised. The platforms 37 and 35 are both raised until the platform 37 reaches its maximum upper level at which point it opens the upper limit switch 231 (2)A and closes switch 231 (2)B. Relay 271 and solenoid 243A then are de-energized. Switch 271A opens, switch 271C closes and switch 271B opens, deactivating the hydraulics causing platform 37 to stop at its maximum upper level. The platforms 37 and 35 then are at their positions shown in FIG. 1 allowing a vehicle to be driven on the base 45 under platform 35.

When it is desired to lower the platforms 37 and 35 from the positions shown in FIG. 1 to their nested positions shown in FIG. 4, any vehicle under platform 35 is removed from the base 45 and switch 285 pushed for closure. This completes a circuit through switches 277B and 231 (2)B causing relay 273 and solenoid 251A to energize. This causes the two upper safety latch cylinders 211 (2) and 211 (4) to activate which in turn causes the two upper safety latches 203 (2) and 203 (4) to retract. When this occurs, upper safety switches 221 (2) and 221 (4) close. When relay 273 is energized, switches 273A and 273B close. Relay 273 and solenoid 251A then are latched in by way of a circuit comprising closed switches 241, 231 (1)A, 221 (4), 221 (2), 273A and 271 (C). The operator then can release switch 285 and push switch 283 for closure. This energizes the down relay 277 and the down solenoid 243B. When relay 277 is energized, switch 277A closes and switch 277B opens. Relay 277 and down solenoid 243B then are latched in by way of a circuit comprising closed switches 277A, 279A, and 273B. The operator then can take his fingers off of switch 283. The platform 37 now will move down until it reaches and opens the mid limit switch 231 (1)A and closes switch 231 (1)B. When this occurs, relay 273 and solenoid 251A become deenergized. Switch 273B opens causing relay 277 and solenoid 243B to become de-energized thereby causing the platform 37 to stop moving. At this point, the platforms 37 and 35 are in the positions shown in FIG. 11.

The vehicle on platform 35 can be removed and platform 37 lowered to its lower nested position as shown in FIG. 4 by pushing switch 285 again for closure. This energizes relay 275 and solenoid 253A through closed switches 277B and 231 (1)B. Solenoid 253A actuates the cylinders 211 (1) and 211 (3) which retract the safety latches 203 (1) and 203 (3) which in turn close switches 221 (1) and 221 (3). Relay 275 and solenoid 253A then are latched in through closed switches 271C, 275A, 221 (1), 221 (3), and 241. The operator then can release switch 285 and push switch 283 for closure which energizes relay 277 and solenoid 243B which then become latched in through closed switches 277A, 279A, and 275B. The platform then continues downward until switch 241 opens causing relays 275 and 277 and solenoids 253A and 243B to become de-energized. Both platforms 37 and 35 are on the ground or base in their nested positions.

Switch 286 provides an emergency stop feature. If it is closed while the platforms are moving, relay 279 is energized opening switches 279A and 279B which in turn de-energizes relays 271 and 277 and solenoids 243A and 243B causing the platform to stop moving.

Although not shown, a bottom car sensor will be employed to determine if the bottom parking stall is empty and if not the system will prevent the platforms from being lowered.

Figure 9:
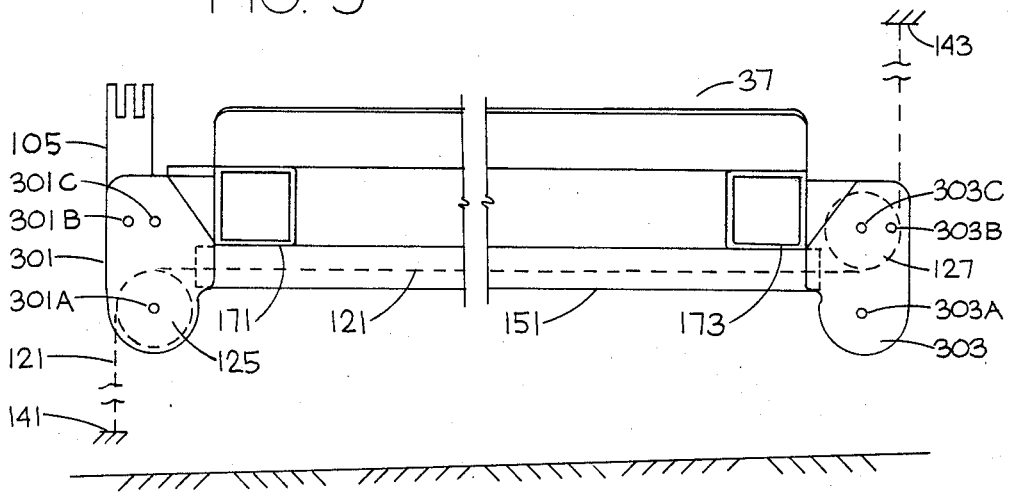
FIGS. 9 and 10 illustrate the leveling mechanism of the upper platform of the lift system installed on grades having different directions.

The single power cylinder 81 avoids synchronization problems which may occur for example if two power cylinders were employed for lifting purposes. The two platforms in effect are free floating which eliminates wear and alignment problems. Because the platforms are free floating they always will be able to conform to the ground even if the system is mounted on a grade. Platform 37 will be allowed to conform to the ground by mounting the power cylinder 81 and the two lift chains 101 and 111 on the downhill side of any grade. The structure of the platform 37 for supporting the pulleys 125, 127 and 129, 131 and the connectors 105 and 115 for the lift chains 101 and 111 is identical at both ends of the platform 37. This structure allows the pulleys and connectors to be located at different positions whereby the platform 37 and hence platform 35 may be located in the frame at either end depending on the direction of the grade, to ensure that the power cylinder 81 and lift chains 105 and 111 are on the downhill side of the grade. This will be explained by reference to FIGS. 9 and 10 which illustrate the platform as seen from its front end 65. In FIG. 9, the downhill side of the grade is on the left and in FIG. 10, the downhill side of the grade is on the right.

Referring to FIG. 9, the structure for supporting the pulleys 125 and 127 and the chain connector 105 are members 301 and 303 which are connected to the outer sides of beams 171 and and 173 and to opposite ends of tubular member 151 at the front end of the platform 37. Identical members 301 and 303 for supporting the pulleys 129 and 131 and the chain connector 115 are connected to outer sides of beams 171 and 173 and to opposite ends of tubular member 153 at the rear end of the platform 37. Members 301 and 303 each has three apertures 301A, 301B, and 301C for supporting the pulleys for the leveling chains and the connectors for the lifting chains at different positions. Apertures 301B, 301C, 303B and 303C are in alignment; aperture 301A is directly below aperture 301C; and aperture 303A is directly below aperature 303C.

With the grade shown in FIG. 9, the pin for pulley 125 will be located in aperture 301A; the pin for chain connector 105 will be located in aperture 301B; and the pin for pulley 127 will be located in aperture 303C. At the other end of the platform, the pulley 129 and chain connector 115 and pulley 131 will be coupled to the platform 37 by way of pins located in the apertures 301A, 301B, and 303C respectively of their members 301 and 303. The power cylinder 81 and the lift chains 101 and 111 will be located on the downhill side of the grade whereby the cross chains 121 and 123 will allow the platform 37 to conform to the platform 35 and hence to the ground when it is in its lower nested position. With the grade shown in FIG. 9, portions of the chains 121 and 123 on the left will be slack when the platform 37 is at its lower nested position at the grade of the ground. When platform 37 is raised, it will level itself sideways first and then the lift chains 101 and 111 will level the front and rear ends of the platform.

Figure 10:
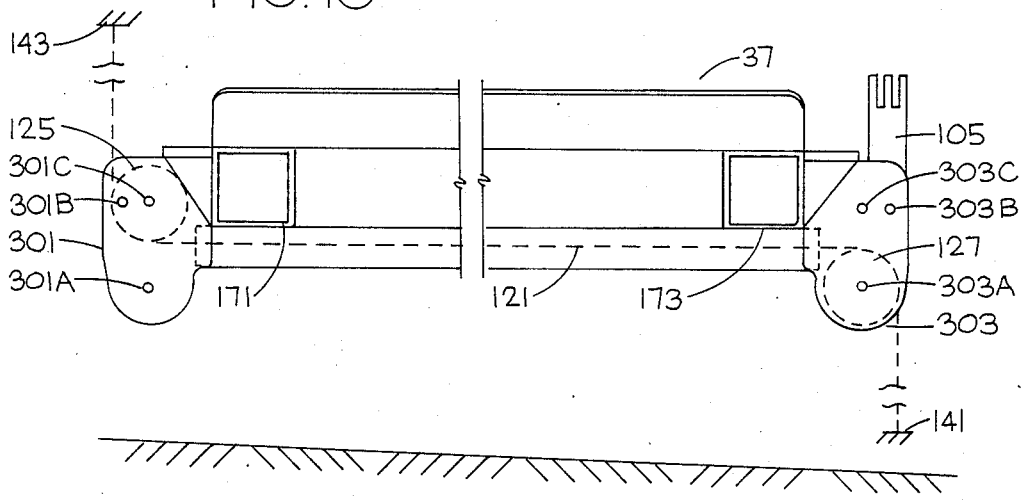

If the grade is in an opposite direction as shown in FIG. 10, the platforms can be located in the opposite end of the frame with the pulleys 125 and 129 coupled to pins located in apertures 301C, the pulleys 127 and 131 coupled to pins located in apertures 303A and the chain connectors 105 and 115 coupled to pins located in apertures 303B. With this arrangement the power cylinder 81 and lift chains 101 and 111 will be located on the downhill side of the grade and the cross chains 121 and 123 will allow the platform to conform to the grade of the ground.

The structure of the platform 37 and the system which allows the platform to conform to the ground is important since it allows many bays of the system to be readily installed, all using identical upper and lower platforms even if the grade changes from one bay to the next. If the grade changes, the platforms can be located in the appropriate frames at different ends whereby the vehicles will enter and leave different bays from different ends. Thus identical platforms and bays can be used for different ground situations resulting in savings in construction costs.

As shown in FIG. 1, each bay is essentially open on its side at the lower level allowing the door of the vehicle to be opened without any obstructions in its way. This allows the width of the bays to be relatively narrow which results in a savings of space and hence cost.

Preferably the length of platform 37 will be longer than the length of platform 35 although it could be shorter and rest entirely on platform 35 when in its lowered position. Although not shown, the upper ends of the cross chains 121 and 123 are connected to the frame by way of a pair of adjustable chain anchors to compensate for variations in grade etc., to allow leveling of the platform 37.

Although the lift system was described as having two platforms 37 and 35 it is to be understood that it could have more platforms. For example it could have one upper platform 37, an intermediate platform similar to 35 and a lower platform similar to 35. In this embodiment, the intermediate platform would be supported and raised by the upper platform 37 by way of four straps similar to straps 181, 183, 185, and 187 and the lower platform would be supported and raised by the intermediate platform by way of four straps similar to straps 181, 183, 185, and 187 offset sufficiently to clear the straps of the platform above. A suitable electrical and hydraulic system and safety latches would be provided for operating this embodiment. In the lower nested positions, the lower platform would be supported by the base or ground, the intermediate platform would rest on the lower platform and the upper platform would rest on the intermediate platform.

We claim:

1. A motor vehicle parking system, comprising:

a frame comprising structural means extending upward from a base, a plurality of platforms adapted to be nested together and supported at lower positions by said base, said plurality of platforms comprising at least a first platform and a second platform located above said first platform, said first and second platforms being adapted to be moved upward between said structural means, said second platform having a first end and a second end with dimensions sufficient to allow a motor vehicle to be driven thereon from its first end when said second platform is supported at its lower position, lifting means for moving said second platform with a motor vehicle thereon upward to a first upper level sufficient to allow a motor vehicle to be located thereunder on said first platform, said first platform having a first end and a second end with dimensions sufficient to allow a motor vehicle to be driven thereon from its first end when said first platform is supported at its lower position, connecting means extending between said first and second platforms such that when said second platform is moved upward beyond said first upper level, said first platform is pulled upward by said connecting means, said lifting means being adapted to move said second platform with a motor vehicle thereon upward to a second upper level sufficient to pull said first platform with a motor vehicle thereon to a level sufficient to allow a motor vehicle to be driven thereunder.

2. The system of claim 1, comprising:

a tilting means for causing said second ends of said first and second platforms to be located higher than their first ends when said first and second platforms are located at their lower positions.

3. The system of claim 1, wherein such structural means comprises:

a pair of spaced apart first beams, a pair of spaced apart second beams, said two pairs of first and second beams being spaced apart sufficient to receive a motor vehicle therebetween, said first beams defining one end of said frame and said second beams defining the other end of said frame.

4. The system of claim 3, wherein:

said first and second platforms can be located between said pair of first beams and between said pair of second beams from either end of said frame.

5. The system of claim 1, wherein:

said lifting means comprises a single power cylinder.

6. The system of claim 1, wherein:

said connecting means comprises:

a first pair of strap means having lower ends coupled to opposite sides of said first end of said first platform and a second pair of strap means having lower ends coupled to opposite sides of said second end of said first platform, said first and second pairs of strap means extending upward from said first platform where they terminate in upper engaging means, said second platform having a pair of first strap receiving means on opposite sides of its first end and a pair of second strap receiving means on opposite sides of its second end for receiving said first and second pairs of strap means respectively, whereby when said second platform is moved upward by said lifting means to a certain level, said engaging means of said first and second pairs of strap means engage said second platform causing said first and second pairs of strap means to pull said first platform upward when said second platform is moved upward beyond said certain level.

7. The system of claim 3, wherein said lifting means comprises:

a cylinder connected to a beam of one of said pairs of beams, and a piston adapted to move upward and downward in said cylinder, first and second pulley means rotatably coupled to said piston, said first pulley means being located lower than said second pulley means, third and fourth pulley means connected to said frame above said cylinder and piston, a fifth pulley means connected to said frame at about the same level as said third and fourth pulley means near a beam of the other pair of beams, said pulley means and said cylinder being located on the same side of said frame, a first main chain means having a first end connected at an upper position to said frame above said cylinder and piston, said first main chain means extending from its upward position downward around said first pulley means, upward and around said third pulley means and downward to a lower position where its other end is coupled to one end of said second platform, a second main chain means having a first end connected to an upward position of said frame above said cylinder and piston, said second main chain means extending from its upper position downward, around said second pulley means, upward and around said fourth pulley means, across and around said fifth pulley means and downward to a lower position where its other end is connected to the other end of said second platform, said piston, when it moves downward, causes said first and second main chain means to pull said second platform upward, and leveling means for maintaining said first and second ends of said second platform level as it moves upward and downward.

8. The system of claim 7, wherein said leveling means comprises:

two pulley means of a first pair of pulley means coupled to opposite sides of one end of said second platform, a first cross-chain means having a lower end coupled to a lower position of one of said first beams, said first cross-chain means extending from its lower position around said two pulley means of said first pair of pulley means to an upper position where it is coupled to the other of said first beams for supporting said first end of said second platform as it is raised and lowered, two pulley means of a second pair of pulley means coupled to opposite sides of the other end of said second platform, a second cross-chain means having a lower end coupled to a lower position of one of said second beams, said second cross-chain means extending from its lower position around said two pulley means of said second pair of pulley means to an upper position where it is coupled to the other of said second beams for supporting said other end of said second platform as it is raised and lowered.

9. The system of claim 8, wherein:

said first and second platforms can be located between said pair of first beams and between said pair of second beams from either end of said frame such that said cylinder and said first and second main chain means will be supported by beams located on the downhill side of any grade extending between said pair of first beams and between said pair of second beams, and said lower ends of said first and second cross-chains will be coupled to the beams located on the downhill side of the grade.

10. The system of claim 7, wherein:

said connecting means comprises:

a first pair of strap means having lower ends coupled to opposite sides of said first end of said first paltform and a second pair of strap means having lower ends coupled to opposite sides of said second end of said first platform, said first and second pairs of strap means extending upward from said first platform where they terminate in upper engaging means, said second platform having a pair of first strap receiving means on opposite sides of its first end and a pair of second strap receiving means on opposite sides of its second end for receiving said first and second pairs of strap means respectively, whereby when said second platform is moved upward by said lifting means to a certain level, said engaging means of said first and second pairs of strap means engage said second platform causing said first and second pairs of strap means to pull said first platform upward when said second platform is moved upward beyond said certain level.

11. The system of claim 8, wherein:

said connecting means comprises:

a first pair of strap means having lower ends coupled to opposite sides of said first end of said first platform and a second pair of strap means having lower ends coupled to opposite sides of said second end of said first platform, said first and second pairs of strap means extending upward from said first platform where they terminate in upper engaging means, said second platform having a pair of first strap receiving means on opposite sides of its first end and a pair of second strap receiving means on opposite sides of its second end for receiving said first and second pairs of strap means respectively, whereby when said second platform is moved upward by said lifting means to a certain level, said engaging means of said first and second pairs of strap means engage said second platform causing said first and second pairs of strap means to pull said first platform upward when said second platform is moved upward beyond said certain level.

12. The system of claim 9, wherein:

said connecting means comprises:

a first pair of strap means having lower ends coupled to opposite sides of said first end of said first platform and a second pair of strap means having lower ends coupled to opposite sides of said second end of said first platform, said first and second pairs of strap means extending upward from said first platform where they terminate in upper engaging means, said second platform having a pair of first strap receiving means on opposite sides of its first end and a pair of second strap receiving means on opposite sides of its second end for receiving said first and second pairs of strap means respectively, whereby when said second platform is moved upward by said lifting means to a certain level, said engaging means of said first and second pairs of strap means engage said second platform causing said first and second pairs of strap means to pull said first platform upward when said second platform is moved upward beyond said certain level.

13. A motor vehicle parking system, comprising:

a frame comprising structural means extending upward from a base, a first platform adapted to be supported at a lower position by said base and to be moved upward between said structural means, a second platform adapted to be supported at a lower position at least partially by said first platform when said first platform is supported by said base, said second platform being adapted to be moved upward between said structural means, said second platform having a front end and a rear end with dimensions sufficient to allow a motor vehicle to be driven thereon from its front end when said second platform is supported at least partially by said first platform and when said first platform is supported by said base, lifting means for moving said second platform with a motor vehicle thereon upward to a first level sufficient to allow a motor vehicle to be located thereunder on said first platform, said first platform having a front end and a rear end with dimensions sufficient to allow a motor vehicle to be driven thereon from its front end when said first platform is supported by said base and said second platform is located at said first level, connecting means extending between said first and second platforms such that when said second platform is moved upward beyond said first level, said first platform is pulled upward by said connecting means, said lifting means being adapted to move said second platform with a motor vehicle thereon upward to a second level sufficient to pull said first platform with a motor vehicle thereon to a level sufficient to allow a motor vehicle to be driven thereunder on said base.

14. The system of claim 13, comprising:

tilting means for causing said rear end of said first platform to be located higher than its front end when said first platform is supported by said base.

15. The system of claim 14, wherein:

the distance between said front and rear ends of said second platform is greater than the distance between said front and rear ends of said first platform whereby when said second platform is at its lower position, its rear end is supported by its first platform and its front end is supported by said base.

16. The system of claim 13, wherein such structural means comprises:

a pair of spaced apart front beams, a pair of spaced apart rear beams, said two pairs of front and rear beams being spaced apart sufficient to receive a motor vehicle therebetween, said front beams defining the front of said frame and said rear beams defining the rear of said frame, said front and rear ends of said first and second platforms respectively being located generally at the front and rear positions of said frame.

17. The system of claim 16, wherein:

said connecting means comprises:

a front pair of strap means having lower ends coupled to opposite sides of said front end of said first platform and a rear pair of strap means having lower ends coupled to opposite sides of said rear end of said first platform, said front and rear pairs of strap means extending upward from said first platform where they terminate in upper engaging means, said second platform having two front strap receiving means on opposite sides of its front end and two rear strap receiving means on opposite sides of its rear end for receiving said front and rear pairs of strap means respectively, whereby when said second platform is moved upward by said lifting means to a certain level, said engaging means of said front and rear pairs of strap means engage said second platform causing said front and rear pairs of strap means to pull said first platform upward when said second platform is moved upward beyond said certain level.

18. The system of claim 16, wherein said lifting means comprises:

a cylinder having a lower end connected to a beam of one of said pairs of beams and a piston adapted to move upward and downward in said cylinder, first and second pulley means rotatably coupled to said piston, said first pulley means being located lower than said second pulley means, third and fourth pulley means connected to said frame above said cylinder and piston, a fifth pulley means connected to said frame at about the same level as said third and fourth pulley means near a beam of the other pair of beams, said pulley means and said cylinder being located on the same side of said frame, a first main chain means having a first end connected at an upper position to said frame above said cylinder and piston, said first main chain means extending from its upward position downward around said first pulley means, upward and around said third pulley means and downward to a lower position where its other end is coupled to one end of said second platform, a second main chain means having a first end connected to an upward position of said frame above said cylinder and piston, said second main chain means extending from its upper position downward, around said second pulley means, upward and around said fourth pulley means, across and around said fifth pulley means and downward to a lower position where its other end is connected to the other end of said second platform, said piston, when it moves downward, causes said first and second main chain means to pull said second platform upward, and leveling means for maintaining said front and rear ends of said second platform level as it moves upward and downward.

19. The system of claim 18, wherein said leveling means comprises:

two front pulley means coupled to opposite sides of said front end of said second platform, a front cross-chain means having a lower end coupled to a lower position of one of said front beams, said front cross-chain means extending from its lower position around said two front pulley means to an upper position where it is coupled to the other of said front beams for supporting said front end of said second platform as it is raised and lowered, two rear pulley means coupled to opposite sides of said rear end of said second platform, a rear cross-chain means having a lower end coupled to a lower position of one of said rear beams, said rear cross-chain means extending from its lower position around said two rear pulley means to an upper position where it is coupled to the other of said rear beams for supporting said rear end of said second platform as it is raised and lowered.

20. The system of claim 19, comprising:

tilting means coupled to the under side of said first platform at its rear end for causing said rear end of said first platform to be located higher than its front end when said first platform is supported by said base, the distance between said front and rear ends of said second platform being greater than the distance between said front and rear ends of said first platform whereby when said second platform is at its lower position, its rear end is supported by said first platform and its front end is supported by said base, said connecting means comprising:

a front pair of strap means having lower ends coupled to opposite sides of said front end of said first platform and a rear pair of strap means having lower ends coupled to opposite sides of said rear end of said first platform, said front and rear pairs of strap means extending upward from said first platform where they terminate in upper engaging means, said second platform having two front strap receiving means on opposite sides of its front end and two rear strap receiving means on opposite sides of its rear end for receiving said front and rear pairs of strap means respectively, whereby when said second platform is moved upward by said lifting means to a certain level, said engaging means of said front and rear pairs of strap means engage said second platform causing said front and rear pairs of strap means to pull said first platform upward when said second platform is moved upward beyond said certain level.

* * * * *